US006389622B1

(12) United States Patent
Her et al.

(10) Patent No.: US 6,389,622 B1
(45) Date of Patent: May 21, 2002

(54) HOSPITAL BED

(76) Inventors: Chiou-Feng Her, No.2, Alley 9, Lane 71, Sec. 3, Pa Te Rd., Taiwan (CN); Chun-Chuan Yu, 9FL., No.59, Tan Hsing St., Shu Lin City, Taipei Hsien (TW)

( * ) Notice: Subject to any disclaimer, the term of this patent is extended or adjusted under 35 U.S.C. 154(b) by 2 days.

(21) Appl. No.: 09/631,768

(22) Filed: Aug. 3, 2000

(51) Int. Cl.[7] ..... A67G 7/00
(52) U.S. Cl. ..... 5/600; 5/425; 5/613
(58) Field of Search ..... 5/425, 424, 426, 5/428, 430, 613, 600

(56) References Cited

U.S. PATENT DOCUMENTS 5,129,117 A * 7/1992 Celestina et al. ..... 5/602
5,926,878 A * 7/1999 Morton et al. ..... 5/624

* cited by examiner

*Primary Examiner*—Lynne H. Browne
*Assistant Examiner*—Fredrick Conley

(74) *Attorney, Agent, or Firm*—Rosenberg, Klein & Lee

(57) ABSTRACT

A bed frame comprises a bed frame, a bed platform, a front plate, a distal plate, and two separate siderails at each side. The bed platform is structured by plurality of plates made by injecting plastics from a mold and serving to enhance the structure. The elevation angle of the bed platform can be adjusted by a driving device. Each of the siderails can be lifted or descended so that the patient can get on or off the bed conveniently. The outer side of each siderail is installed with at least one inner concave groove for fingers insertion when pull or push the siderails for safely purpose. Inner side of one siderail is installed with a motor controller to drive the driving device. The design will prevent the event of losing or destroying since it is fixed at a proper place. Besides, lower corners of the front and distal plates are installed with an impact-proof head to prevent the patient or others from being harmed by the corners. In particular, movable clamping pieces comprising a fixing seat, a pressing plate, a movable rear clamping plate, and a tightening block, are preset to the front plate and distal plate. With the special connection of the movable clamping pieces, the front plate and distal plate can be assembled or detached conveniently and easily.

6 Claims, 16 Drawing Sheets

HOSPITAL BED

FIELD OF THE INVENTION

The present invention relates to a hospital bed, and especially to a novel hospital bed structure, thereby, the operation and assembly of the bed is simple and convenient, the structure is enhanced, the use of the hospital bed is effective, and it satisfies the need of the patients and medical staffs.

BACKGROUND OF THE INVENTION

As shown in FIG. 1, the conventional hospital bed is illustrated. It is basically comprises of a bed frame 10, a bed platform 11, a front plate 12 and a distal plate 13 installed at both the front and rear ends of the bed frame 10, respectively, and siderails 14 installed at two sides of the bed frame 10. In order not to hinder the mobility of the patient and to protect him or her from the patient falling down from the bed, the siderails 14 are designed to be lifted and descended. As shown in the figures, the siderails can be pulled or pushed laterally so as to lift or descend. Siderails of some hospital bed are adjusted by rotating a crank. In this case, since no proper force applied point is designed in the conventional hospital bed, it is common of the user to hold the transversal rods to push or pull the siderail 14 instead. As a result, it happens often that the user's fingers being hurt by the edges of the siderail 14 or the bed platform 11. This troubles medical staff very much.

Furthermore, in the prior art hospital bed, in order for a patient with a serious disease to conduct activity easily, the bed platform 11 is designed to be structure with a plurality of plates 110. A driving device is also installed in the bed frame 10 so that the patient can control the with a controller or a remote controller to adjust the bending angle of the bed platform to satisfy one's need. However, despite a line controller or a remote controller, it is often not fixed at one place properly so that it is sometimes difficult to be locate when needed. Moreover, it is possible to be broken due to press or impact. Furthermore, since the patient's physical condition is weak, thus a complete safeguard is necessary. The prior art hospital bed as shown in FIG. 1 has many sharp corners which may hurt the patient, especially, the corners at the two lower sides of the front plates 12 and distal plates 13. Not only the patients or the medical staffs are easily harmed due to collision, the corners can also hit the peripheral object easily to induce a dangerous event.

Besides, for the hospital bed 11, since each plate 110 of the prior art hospital bed 11 must be made by pressing a mold, namely, as shown in FIGS. 2 and 3. The plate 110 includes protruded edge strips 111, slide-proof strips 112, slide-proof blocks 113 and concave vents 114 and are made by pressing respective mold individually. Consequently, the whole process for completing a whole bed platform needs many times and work. Moreover, the original plates with uniform thickness must become thinner after forming the aforesaid protruded edge strips 111, slide-proof strips 112, slide-proof blocks 113 and concave vents 114. This phenomenon becomes apparent at the edges and curved portion (as shown in FIG. 3) so that the plates 110 without enhancing structure become weak. Therefore, a further supporting strip 115 is required to be adhered to the concave space at the bottom of the slide-proof strips 112. Furthermore, the prior art hospital bed can bend at the transversal direction by pressure (as shown in FIG. 4). The thin edges at aforesaid structure, will be formed with coarse surface, not only unbeautiful, but also too sharp to preserve safety.

The front plate 12 and the distal plate 13 at two ends of the bed frame 10 are inserted vertically, and can be undetached for medical and emergency purposes. Both plates are usually loosely attached in a conventional sickbed. The phenomena may be dangerous during transporting patients in a hospital.

Therefore, there is an eager demand for a novel hospital bed by which many defects can be improved.

SUMMARY OF THE INVENTION

Accordingly, the primary object of the present invention is to provide a sickbed comprises a bed frame, a bed platform, a front plate, a distal plate, and separate siderails at each side. The outer side of each of the four siderails is installed with at least one inner concave groove for being inserted by fingers to pull or push the siderails safely. Inner side of one siderail is installed with a controller for driving the driving device. The operation thereof is conveniently and labor-saved.

Another object of the present invention is to provide a hospital bed, wherein The front siderail is installed with a remote or line controller at one side for controlling the elevation angle of a bed platform, which is easily achieved by arm of a patient or medical staff.

A further object of the present invention is to provide a hospital bed, wherein lower corners at two sides of the front plate and distal plate are installed with an impact-proof head for protecting the patient or others from being harmed. Moreover, as the hospital bed is moved, they will not harm anyone.

A yet object of the present invention is to provide a hospital bed with multiple plate, wherein The corners stoppers, sliding-proof strips, vents, ribs are formed integrally. Thus, these structures have a uniform thickness not to become thinner so as to destroy the structure. Moreover, the edge will be smooth without hurting anyone. The plurality of enhancing ribs formed at one time supporting the bed platform from the lower side, thus the structure is enhanced. Each plate of the platform, made of ABS is waxhable. Since the bed platforms can be taken off completely, they provide a convenient condition for routine maintenance and repair purpose.

A still object of the present invention is to provide a hospital bed, wherein the front plate and distal □□plate of the bed frame can be assembled easily and conveniently. The bed frame is installed with a movable clamping piece which includes a fixing seat, a pressing plate which can be pushed or pulled, a rear clamping plate movably connected to the fixing seat, and a tightening block connected between the pressing plate and the rear clamping plate. By the special linkage therebetween, the user only needs to push the pressing plate, the plate can be clamped. As the pressing plate is pulled upwards, the plate is released and can be detached easily. The various objects and advantages of the present invention will be more readily understood from the following detailed description when reading in conjunction with the appended.

DETAILED DESCRIPTION OF THE PREFERRED EMBODIMENTS

Figure 1:
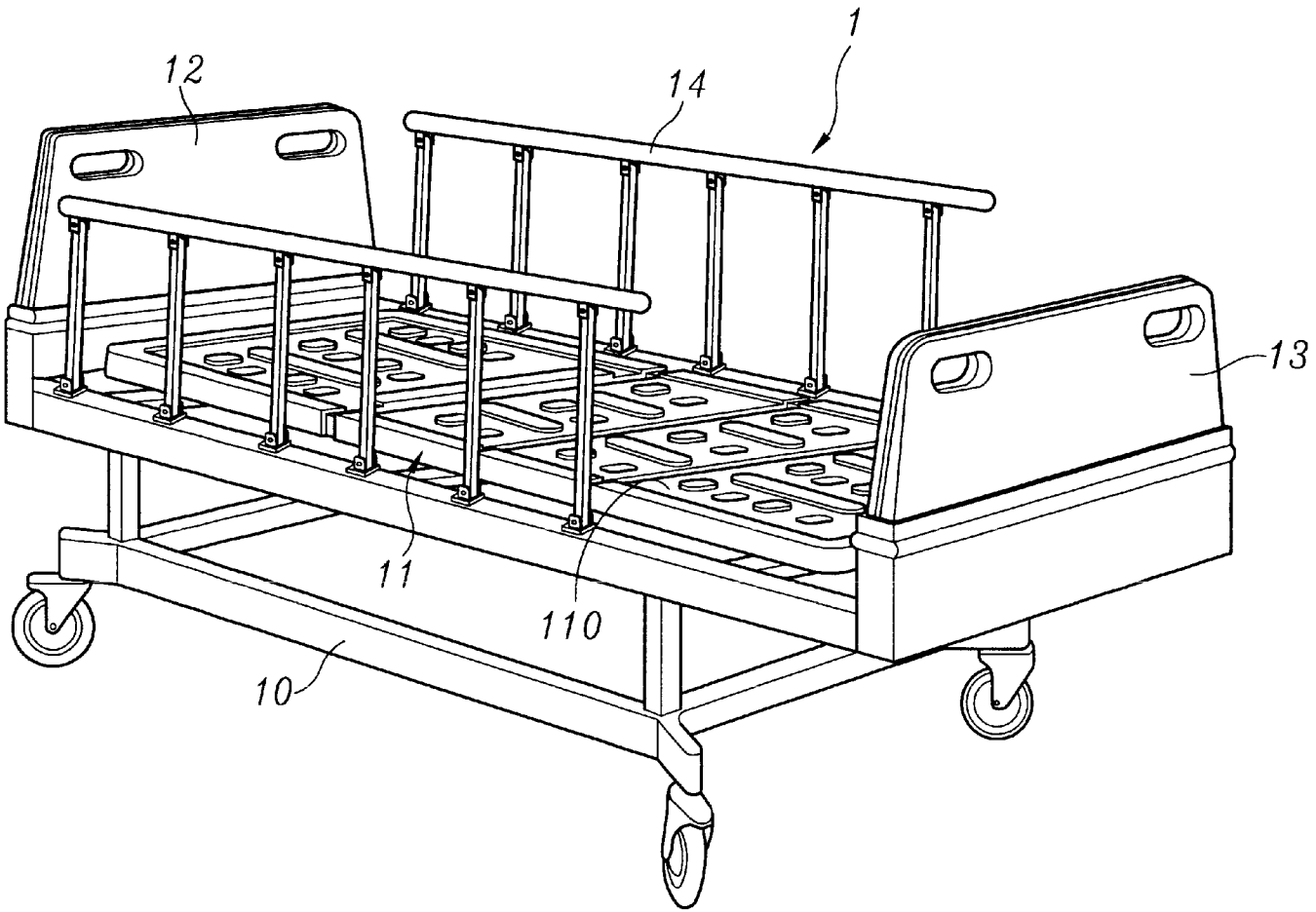
FIG.1 PRIOR ART
FIG. 1 is a perspective view of a prior art hospital bed.
Figure 2:
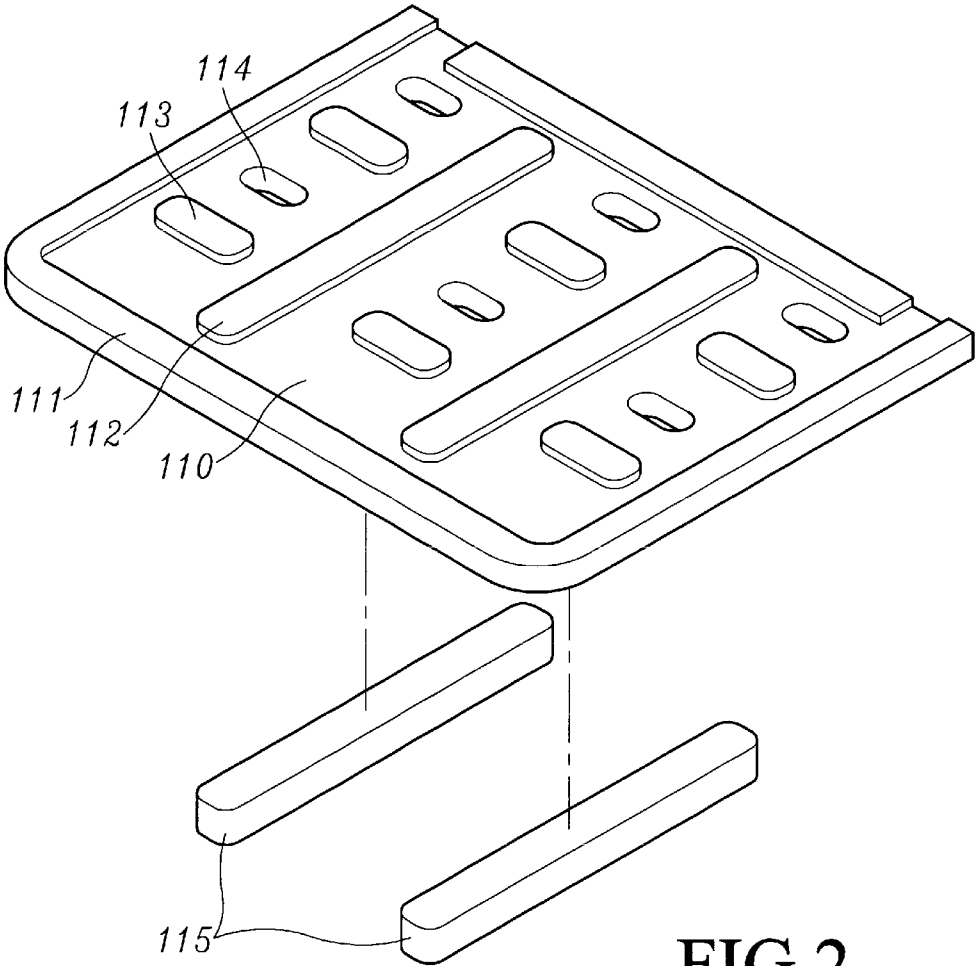
FIG. 2 is a perspective view showing part of the bed platform of the hospital bed in Fig.
Figure 3:
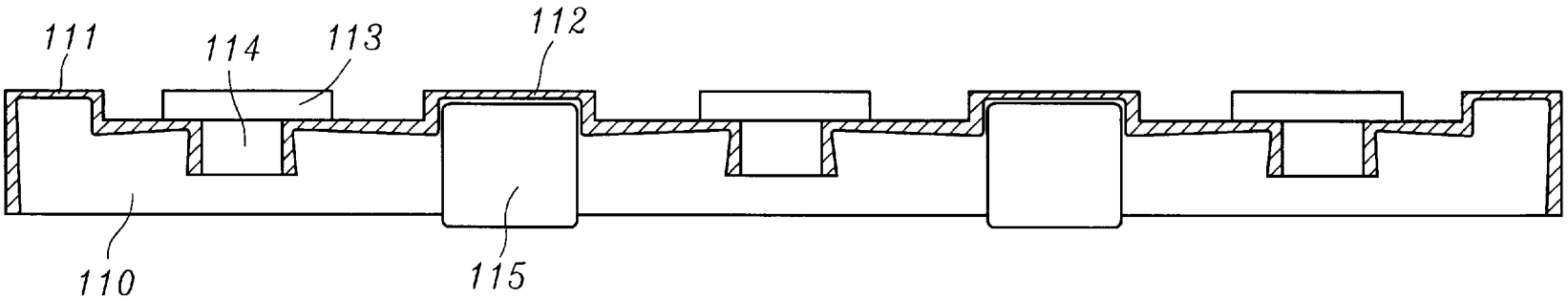
FIG. 3 is a transversal cross sectional view of one plate in FIG. 2.
Figure 4:
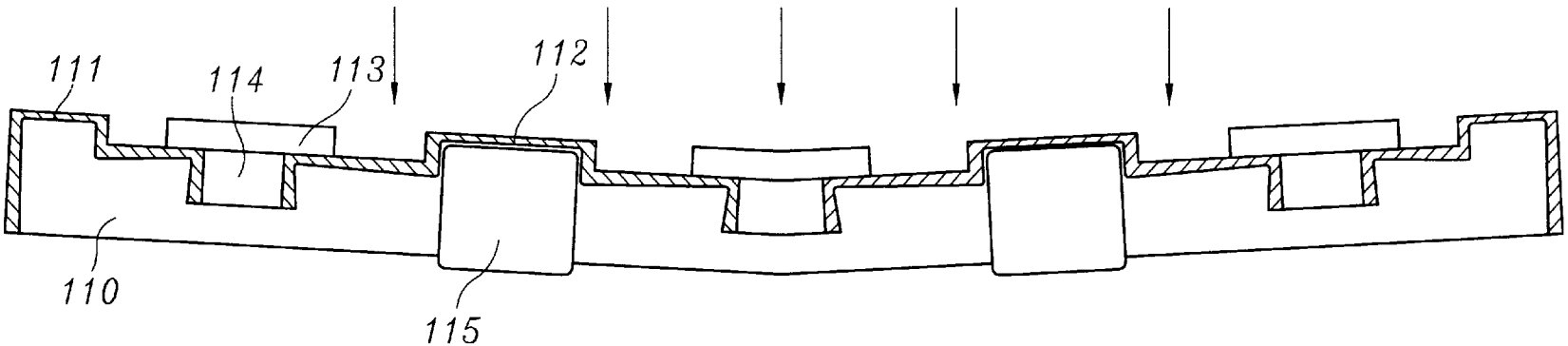
FIG. 4 is a transversal cross sectional view of one plate in FIG. 2, wherein the plate is pressed to bend.
Figure 5:
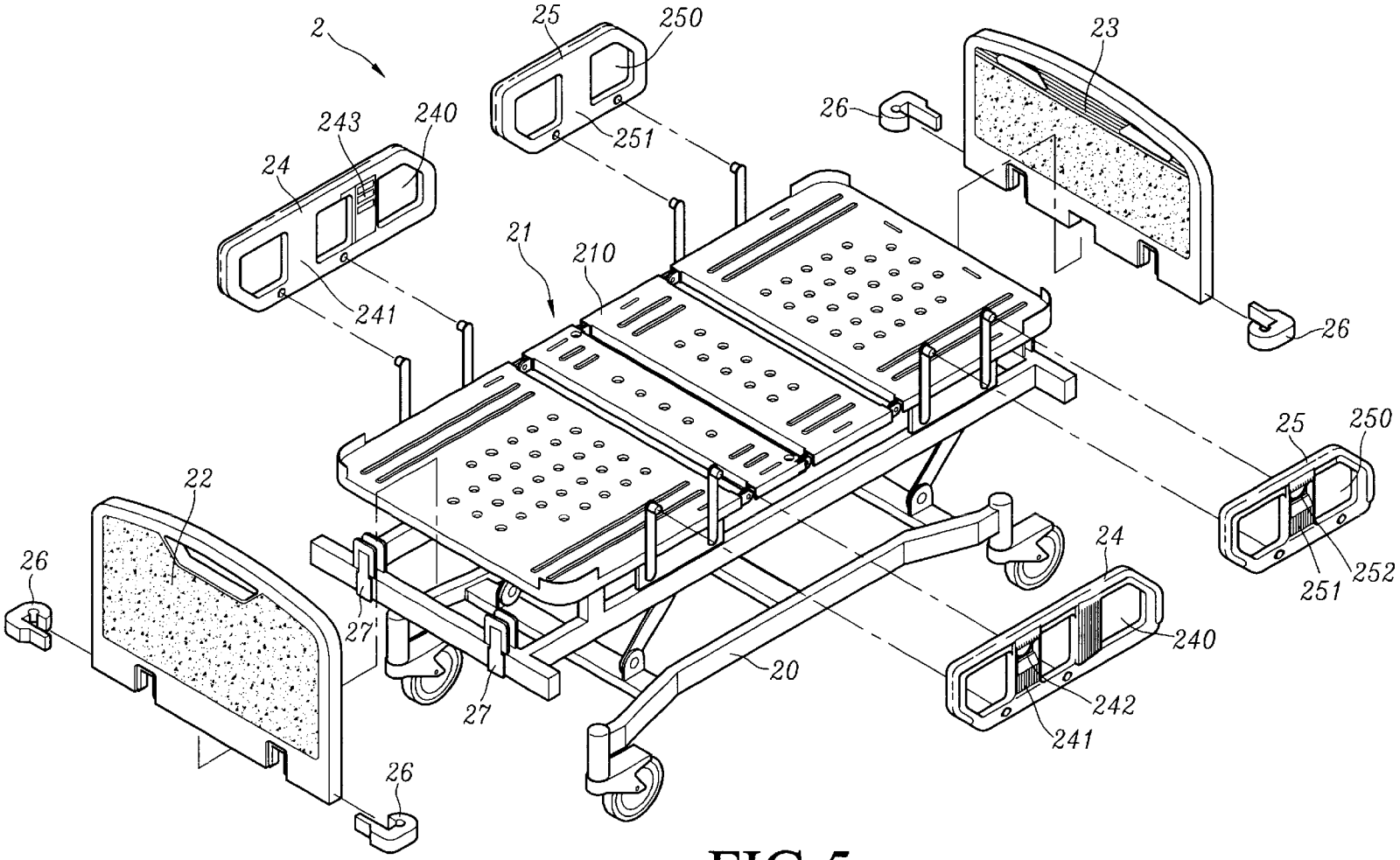
FIG. 5 is an exploded perspective view of the present invention.
Figure 6:
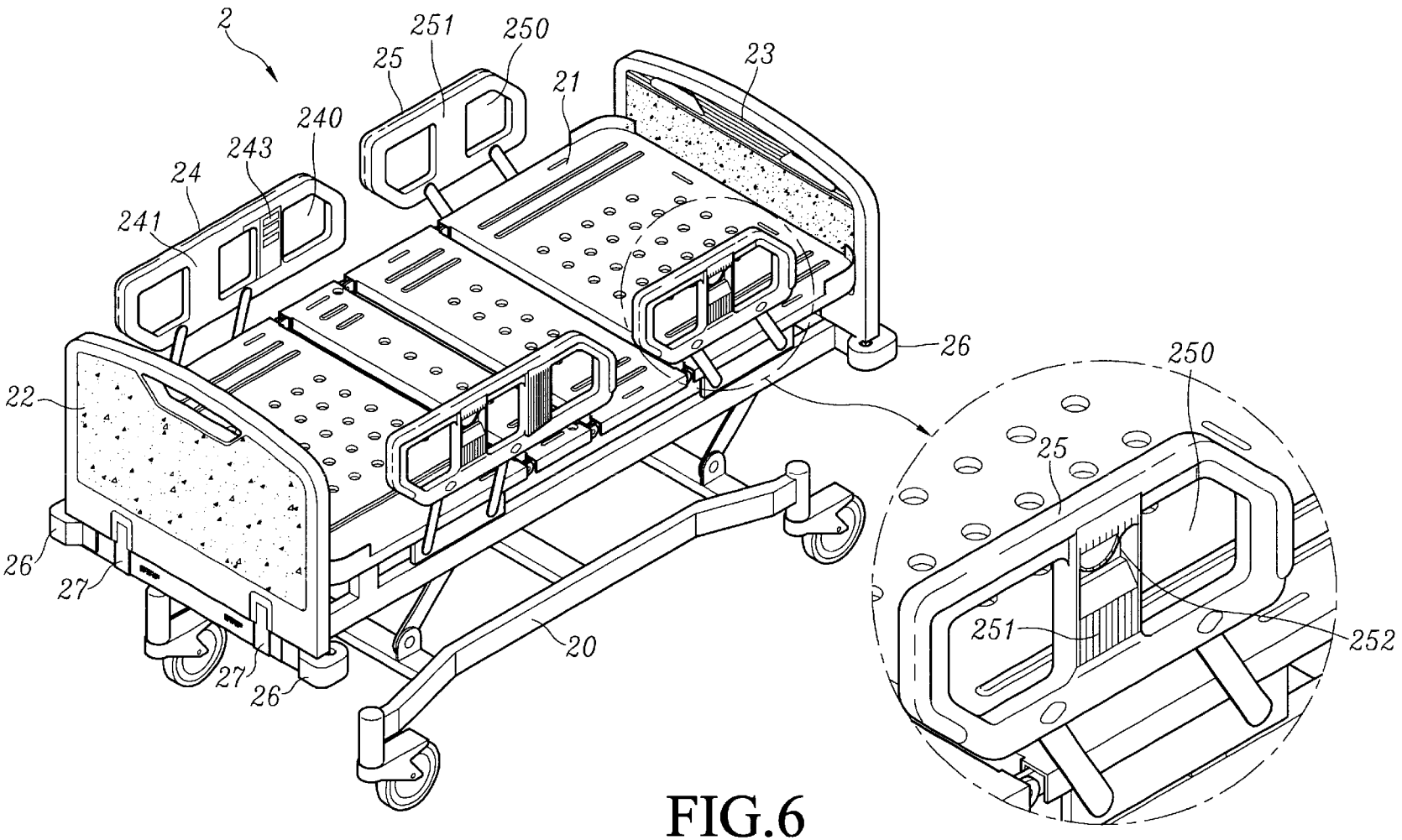
FIG. 6 is an assembled perspective view of the present invention.

With reference to FIGS. 5 and 6, the exploded and assembled perspective views of a preferred embodiment about the hospital bed of the present invention are illustrated. The hospital bed of the present invention includes a bed frame 10, a bed platform 21 supported by the bed frame 20, formed by pivotally connecting a plurality of plates 210 in series, and movable by a driving device within the bed frame 20 so as to be bent to a desired elevation angle, a front plate 22 and a distal plate 23 installed at the front and distal ends of the bed frame 20, respectively, front siderails 24 and rear siderails 25 installed at two sides of the bed frame 20 and operated by a rotating device for lifting and descending.

Each of the siderail 24, 25 both in the front and the rear has holes 240 and 250, respectively, and longitudinal strips 241 and 251. At least one longitudinal strips 241 and 251 of each front siderail 24 and rear siderail 25 is designed with an inner concave groove 242 which provides a holding point for operation. In addition, the longitudinal strip 241 of one front siderail 24 is installed with a remote or line controller 243. Besides, a compact-proof head 26 with an approximate "7" shape is mold in the corners of each front plate 22 and distal plate 26.

Figure 7:
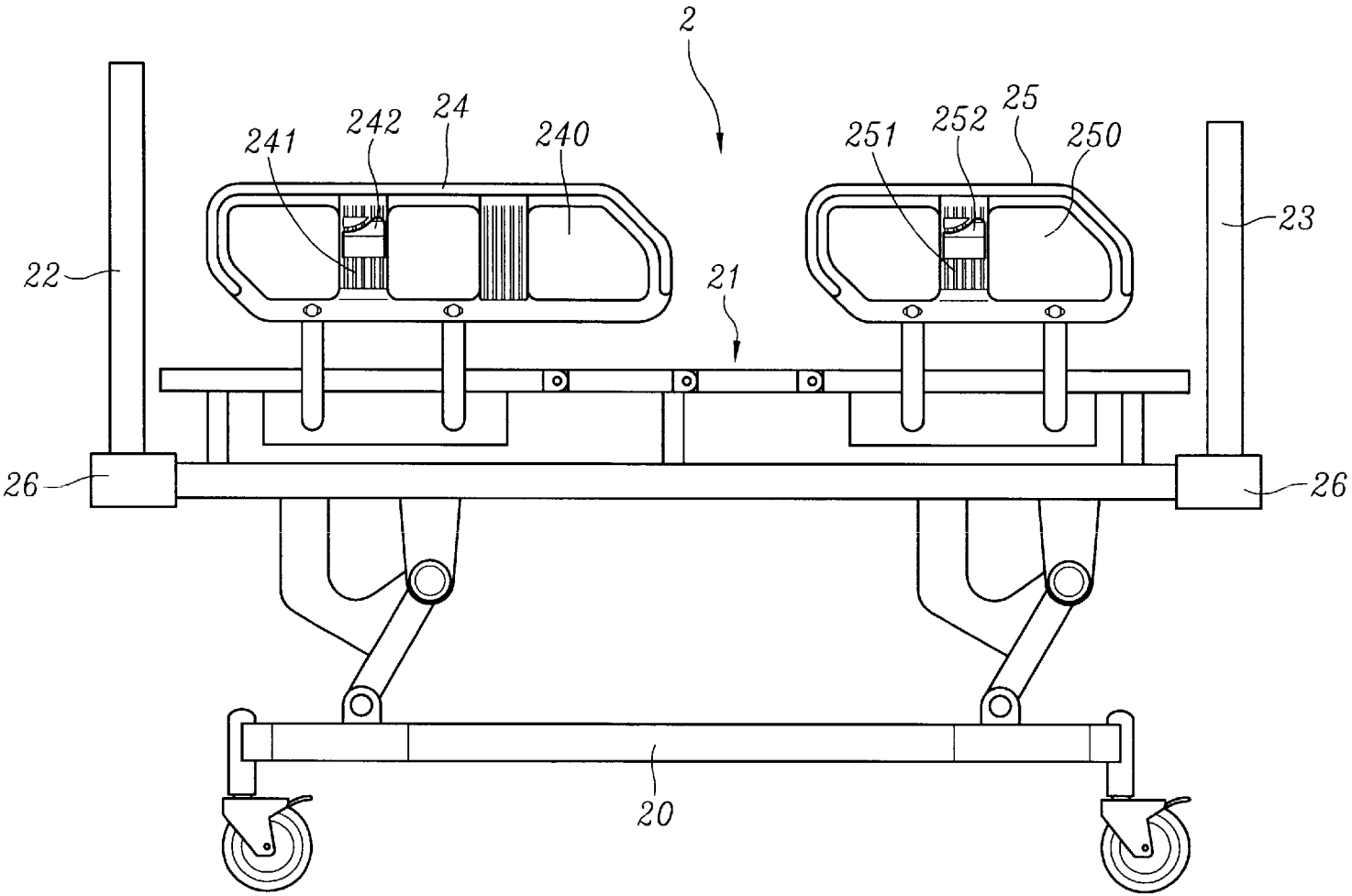
FIG. 7 is a lateral plan view of the present invention.
Figure 8:
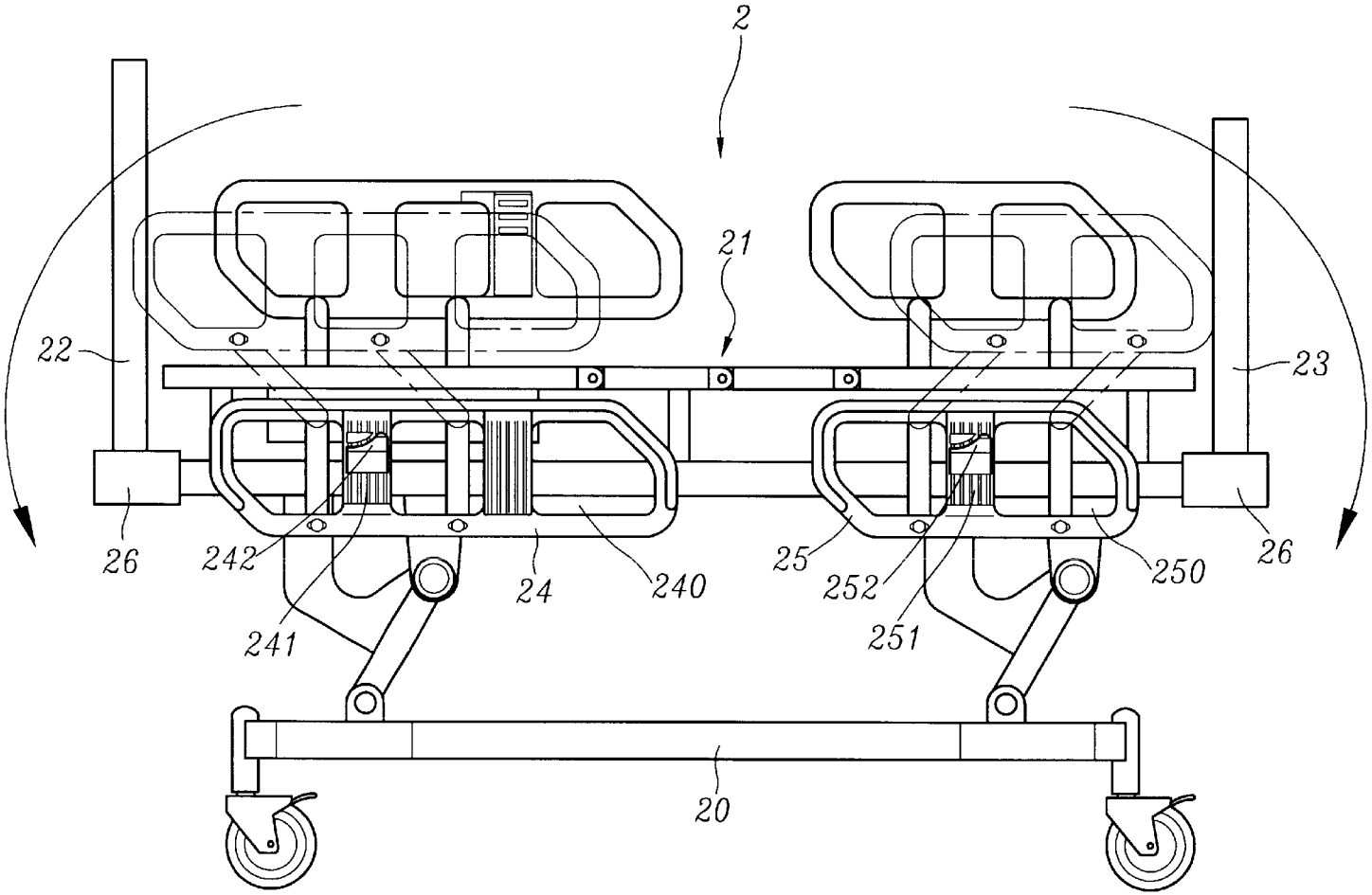
FIG. 8 is a lateral plan view showing the lifting and descending of the siderail in the present invention.

Since each outer side of the front siderail 24 and rear siderail 25 has a design of inner concave grooves 242 and 252, respectively. The front or rear siderails 24 and 25 can be lifted or descent separately as needed. If the patient want to get on or off the bed, he (or she) may insert the fingers into the inner concave grooves 242 and 252 to push the siderails inward and then to rotate the siderail counterclockwise or clockwise for lifting or lowering the bed (as shown in FIGS. 7 and 8). Thus, it prevents the fingers from being clamped between the siderails and the bed platform 21. Moreover, the lifting and descending of the front and rear siderails are easy and convenient.

On the other hand, the inner side of the front siderail 24 is installed with a controller 243 which is fixed and serve as the elevation controller of the bed platform 21, and moreover is space effectively. The controller 243 is located where the patient can easily reach and operate. No matter the operator is the patient on the bed or the family member by the bedside. The controller is no longer hard to reach, easy to loose or broken as in a conventional bed.

Moreover, in the conventional hospital bed 2, the four corners of the bed frame may harm people easily. Impact-proof heads 26 with a round shape are installed thereon. This design may protect medical staffs from accident during patient transfer.

Figure 9:
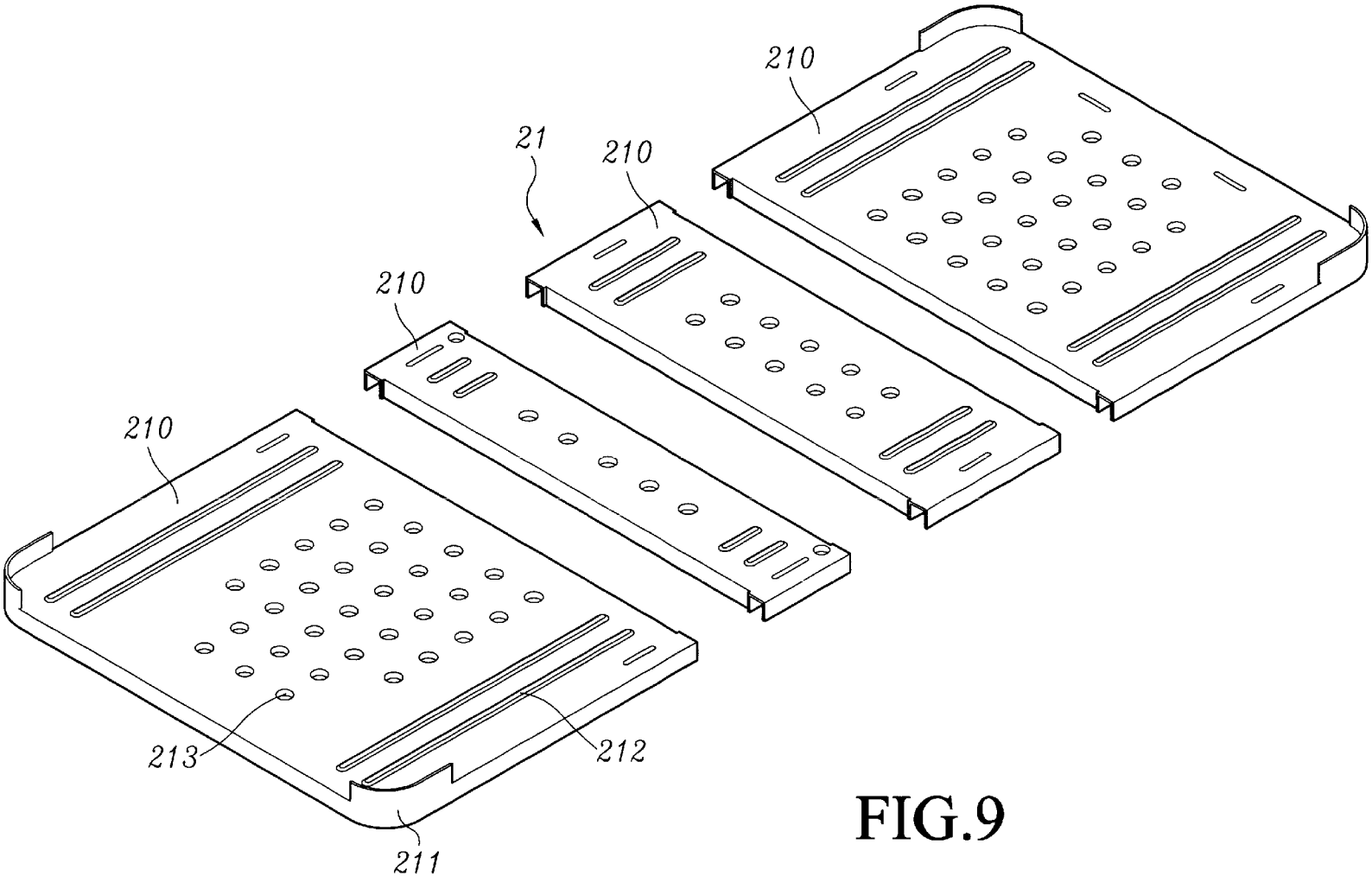
FIG. 9 is a perspective view showing the structure of the bed platform in the present invention.
Figure 10:
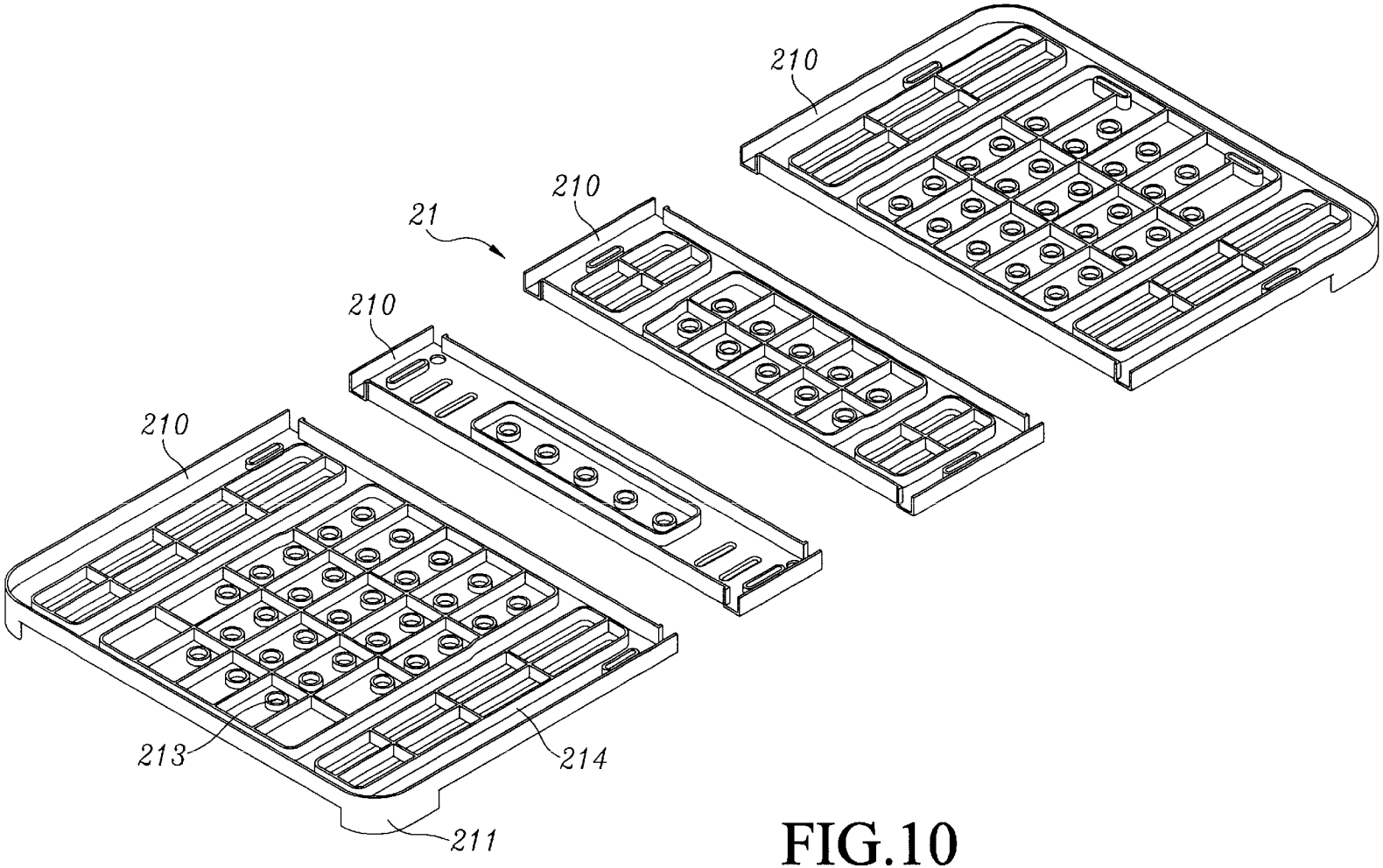
FIG. 10 is a perspective view showing the bottom of the bed platform structure of the present invention.
Figure 11:
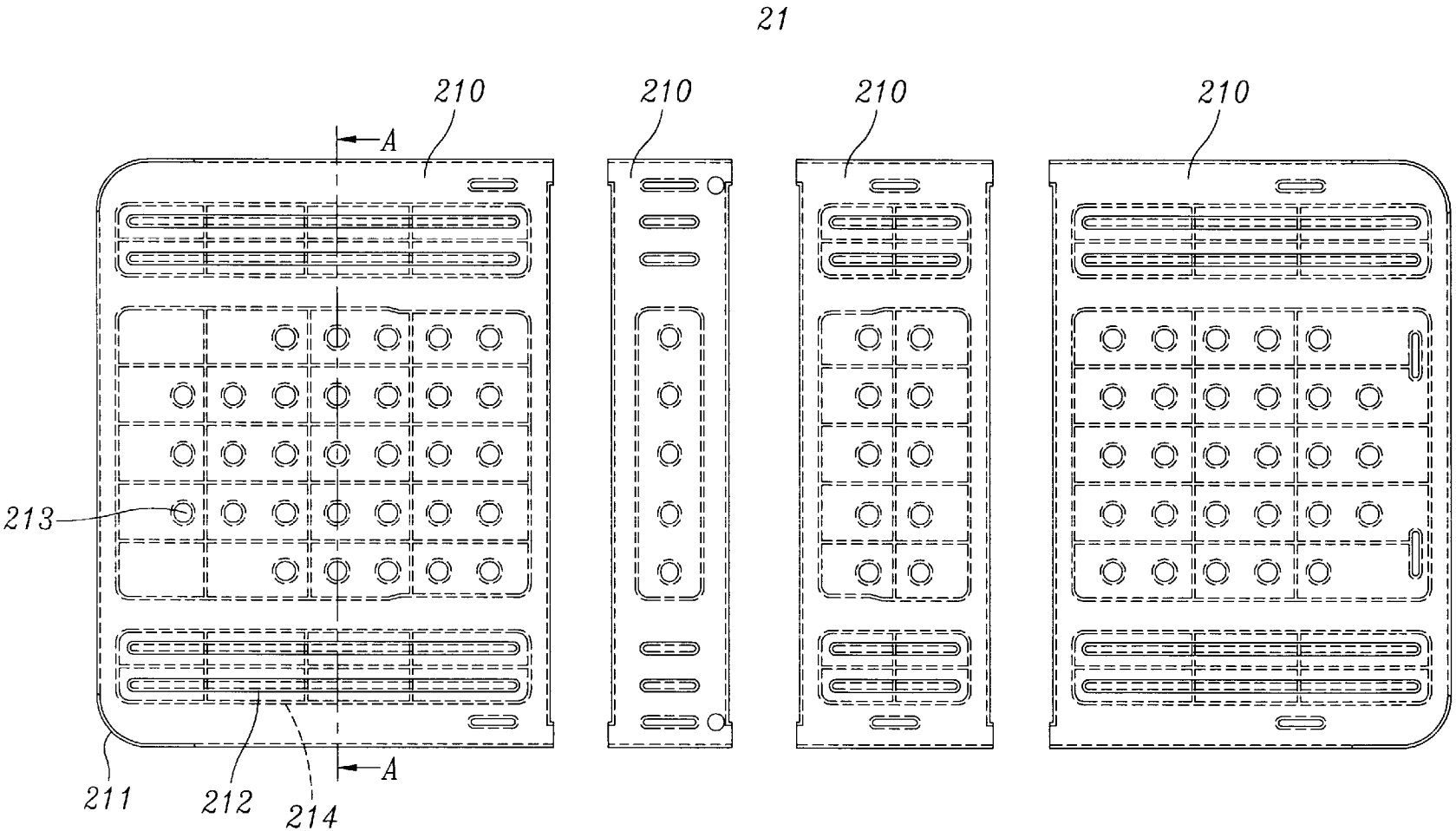
FIG. 11 is an upper view of the bed platform structure of the present invention.
Figure 12:
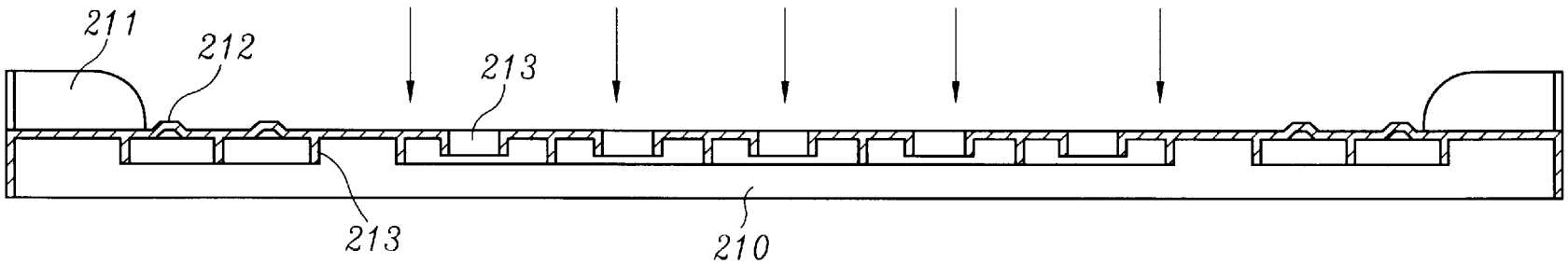
FIG. 12 is a transversal cross sectional view along the line A—A of FIG. 11 as the bed platform is pressed.

The bed platform 21 of the hospital bed 2 is formed by a plurality of plates 210, as shown in FIG. 9, and the four corners of the bed platform 21 are designed with L shape corner stoppers 211 for confining the bed pad as to be positioned on the bed platform 21. A plurality of sliding-proof strips 212 are slao molded on the proper positions of the plates 210. Moreover, a plurality of vents 213 is penetrated therein for dissipating heat. The bottom of each plate 210 is structured with a plurality of ribs 214 which are interleaved and downwards convex (as shown in FIGS. 10 and 11). They enhanced the structure of the bed platform 21, so not to be deformed under to pressure (as shown in FIG. 12). It should be noted that each plate 210 is injected integrally from a mold with plastics. The corners stoppers 211, sliding-proof strips 212, vents 213, ribs are all formed integrally. Thus, they have a uniform thickness. Moreover, the edge of the platform is for safety purpose.

Figure 13:
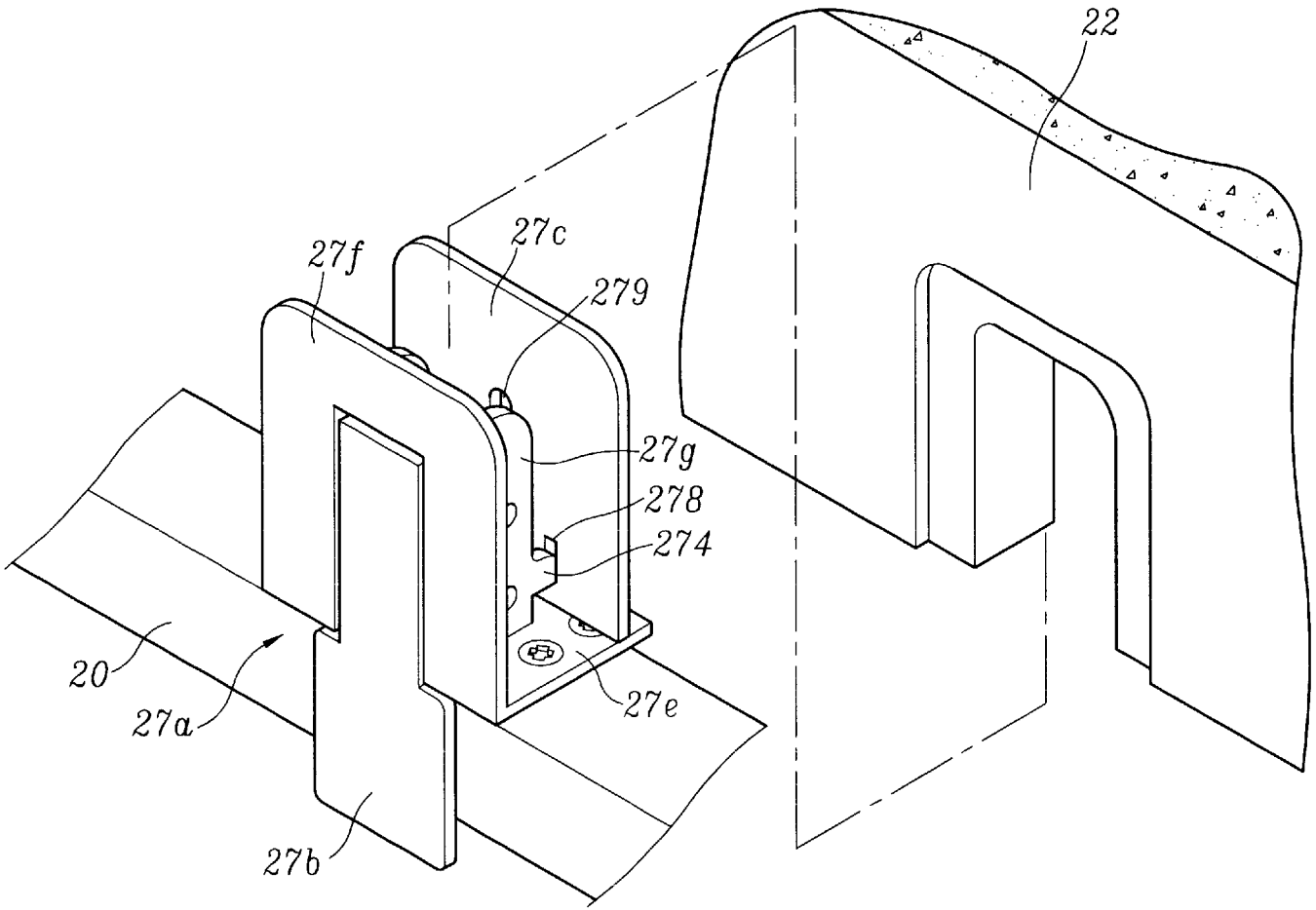
FIG. 13 is a schematic perspective view showing the bed platform of the present invention is fixed to the bed frame by a movable clamping pieces.
Figure 14:
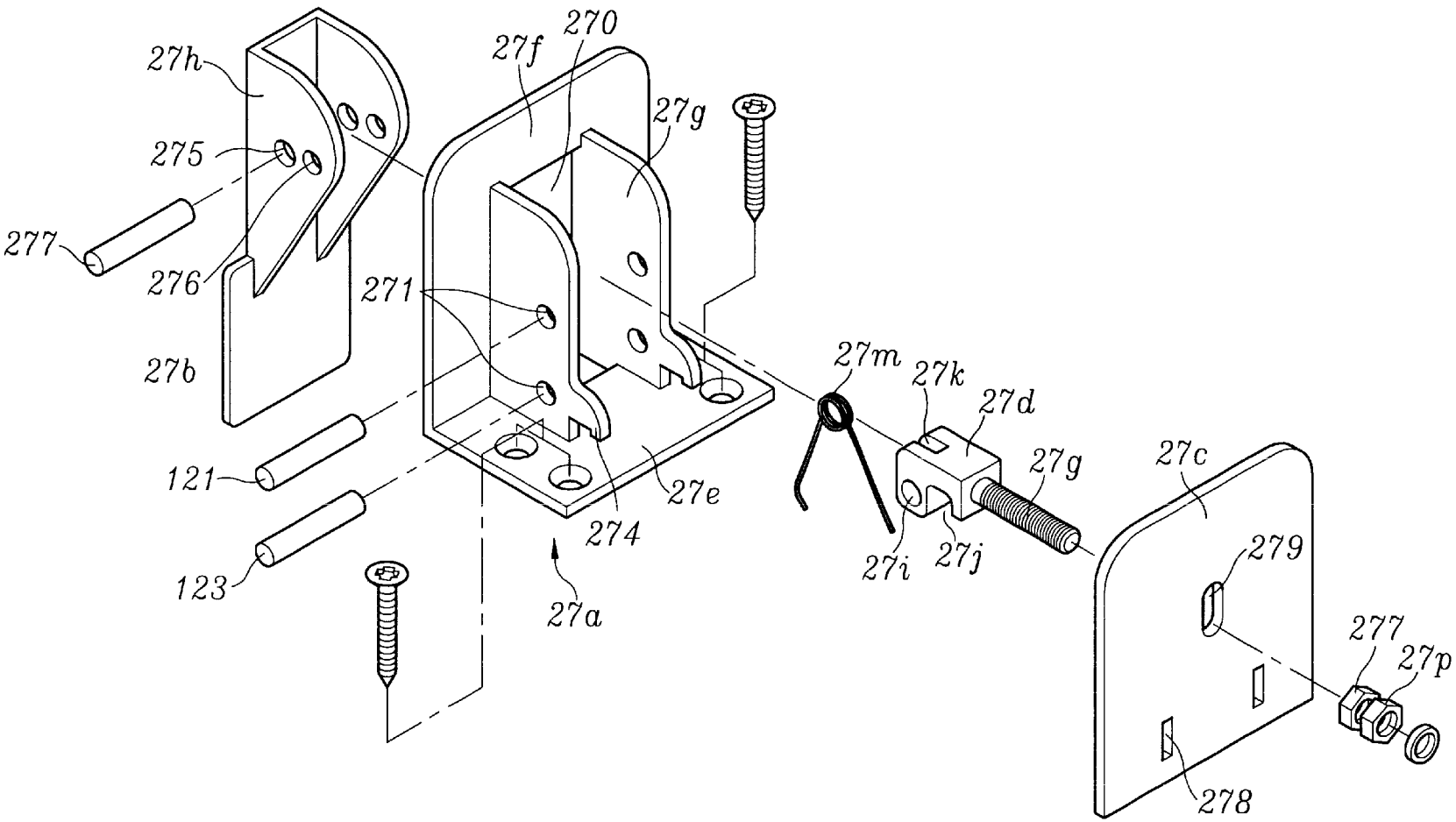
FIG. 14 is an exploded perspective view of the movable clamping piece of the present invention.

Additionally, the front plate 22 and the distal plate 23 are be secured fixedly to the bed frame 21 by a set of movable clamping pieces 27 at front and rear end of the bed frame 20 (as shown in FIG. 13). FIG. 14 shows the structure of the movable clamping pieces 27 which comprises a fixing seat 27*a*, a pressing plate 27*b*, a movable rear clamping plate 27*c* and a tightening block 27*d*.

The fixing seat 27*a* is a fixing lower plate 27*e* with an L shape and a front clamping plate 27*f*. The lower plate 27*e* is fixed to the bed frame 20, while a movable hole 270 is on the front clamping plate 27*f*. Two sides of the movable hole 270 are matched with two parallel outer plates 27*g* extending rearwards. An upper and lower through holes are lined up at the correspondent positions of the two outer plates 27*g*, and a rear pivotal shaft 272 and a pin 273 are penetrated therethrough. The rear side of the two outer plates 27*g* are formed with hooks 274 near the bottom thereof.

Two sides of the pressing plate 27*b* extended rearwards to be formed with two parallel inner plates 27*h* with a gap therebetween is not larger than that of the two outer plates 27*g*. A front through hole 275 and a rear through hole 276 arranged at respective front and rear positions are formed at the correspondent positions of the two inner plates 27*h* so that the pressing plate 27*b* can pass through the movable hole 27*o* of the two inner plate 27*h* to cause the rear through hole 276 to pass through the rear pivotal shaft 272, and thus it can rotate with the aforesaid fixing seat 27*a*. A front pivotal shaft 277 passes through the front through hole 275.

Tow lower sides of the movable plate 27*c* are installed with respective hooks 278 so as to be movably hooked by the hook 274 at the rear sides of the two outer plate 27*g* so as to be opposite to the front clamping plate 27*f*. Moreover, a vertical long hole 279 is further installed in the plate.

Figure 15:
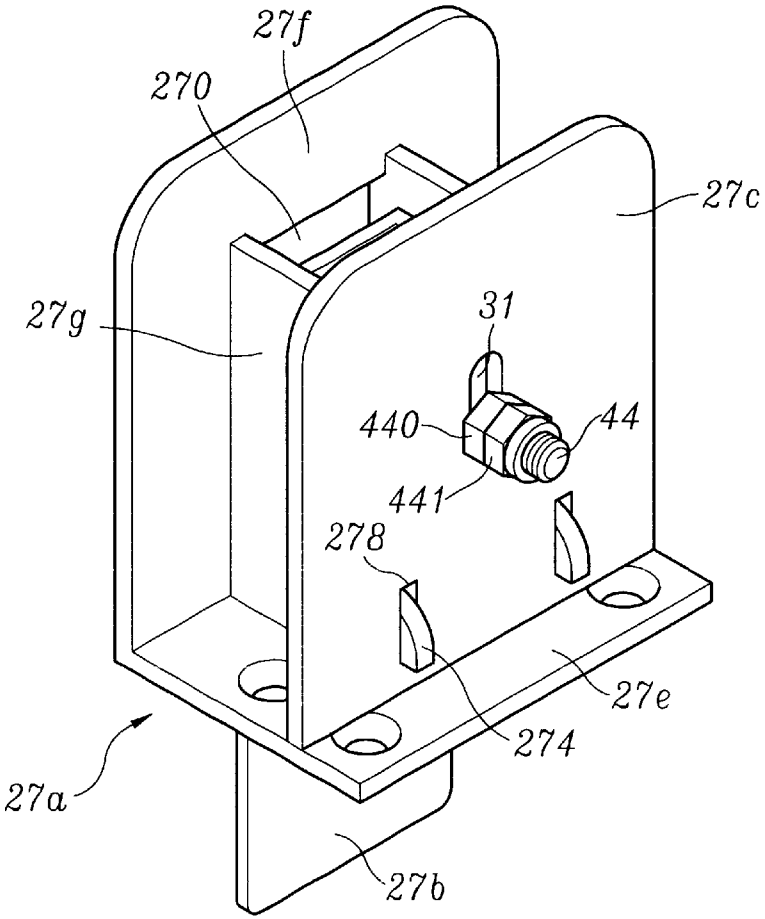
FIG. 15 an assembled perspective view of the movable clamping piece of the present invention.

A pivotal hole 27*i* and a groove 27*j* arranged at front and rear positions, respectively, are formed at the tightening block 27*d* so that by the front pivotal shaft 277 to pass through the pivotal hole 27*i*, the tightening block 27*d* is movable with respective to the pressing plate 17*d*. The groove 27*j* will be positioned above the rear pivotal shaft 272. In the tightening block 27*d*, a groove 27*d* vertically cutting to the pivotal hole 27*i* is installed so that a twisted spring 27*m* covers the front pivotal shaft 277 in the groove 27*k* so that one end thereof resists against the pressing plate 27*b*, while another end resists against the pin 273. The rear end of tightening block 27*d* is further extended with screw rod 27*q* penetrating through a long hole 27*q* of the rear clamping plate 27*c* and then is fixedly locked through a nut 27*n* and a loosen-proof nut 27*p* so that a gap is formed between the rear clamping plate 27*c* and the screw rod 27*q* for moving upwards and downwards. Therefore, the movable clamping piece 27 as shown in FIG. 15 is formed.

Figure 16:
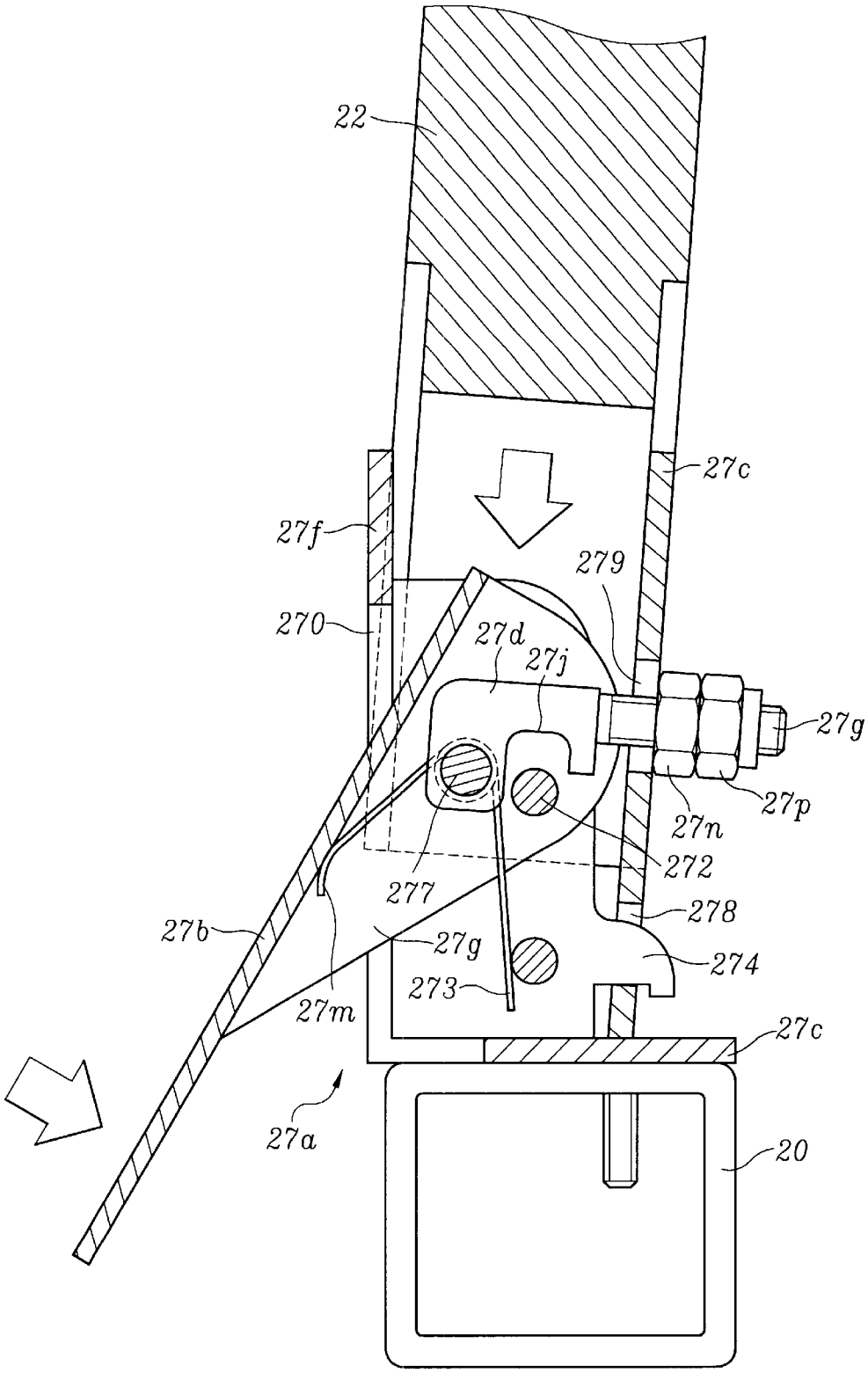
FIG. 16 is a lateral cross sectional view showing the releasing of the bed platform according to the present invention.
Figure 17:
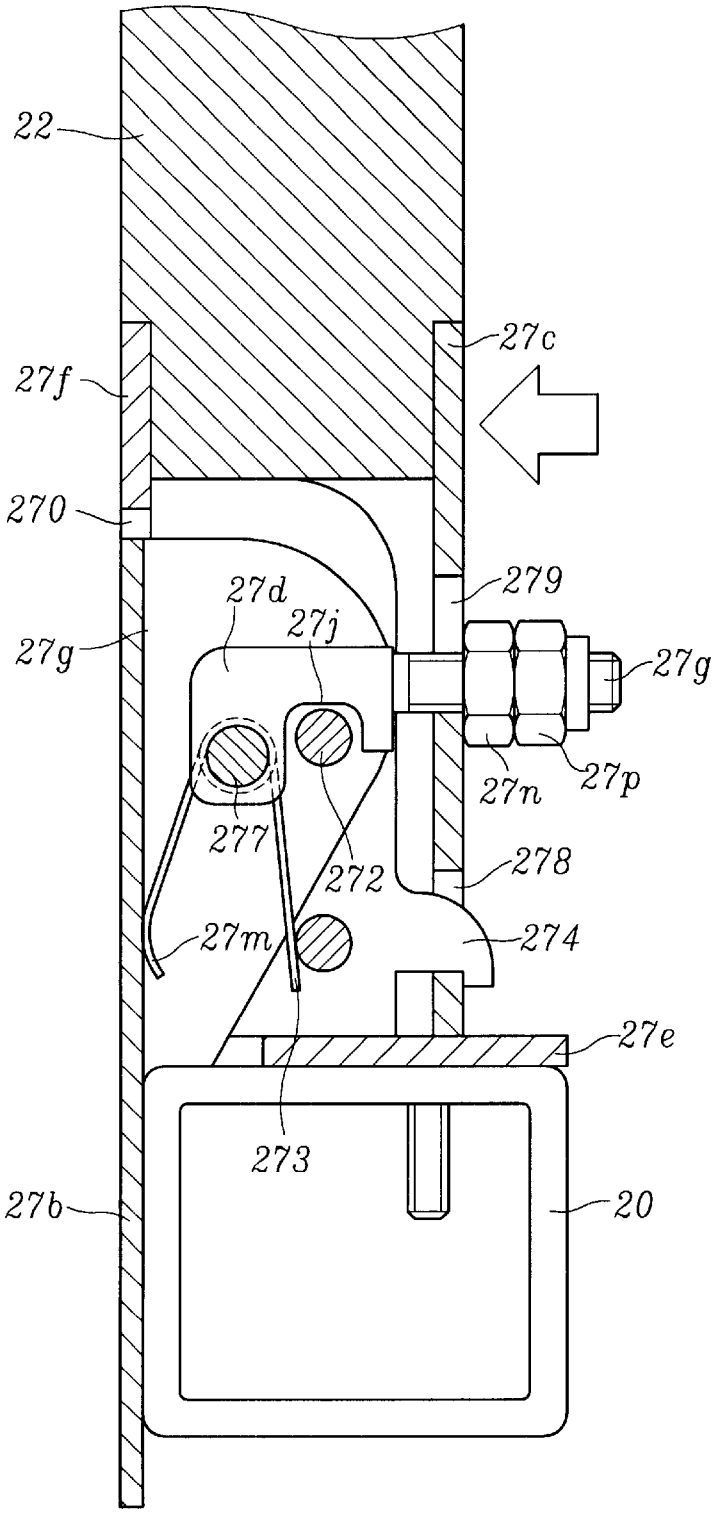
FIG. 17 is a lateral cross sectional view showing the fixing of the bed platform according to the present invention.

As shown in FIG. 16, before putting in the front plate 22 (or the distal plate 23) the clamping piece 27 is fixed to the front and rear end of the bed frame 20 by the fixing seat 27*s*. When the pressing plate 27*b* is opened outwards, if will rotate clockwise around the rear pivotal shaft so that the tightening block 27*d* moves with the rear pivotal shaft 277 and then the groove 27*i* withdraws from the rear pivotal shaft 277 so as to move afterwards. Therefore, the inner lateral plate 27*g* rejects against the rear clamping plate 27*f* rearwards. Under this condition, the rear clamping plate 27 will be opened with respect to the front clamping plate 27*f* (but it will be separated due to the confinement of the nut 27*n* and the hook 27*f*). Once it has been inserted into the space between the front clamping plate 27*f* and the rear clamping plate 27*c*, the user may push the pressing plate 27*b* rearwards. Then, the front pivotal shaft 277 will inversely rotate downwards counterclockwise so that the tightening block 27*d* are integrally pulled to force the nut 27*n* to press against the rear clamping plate 27*c*, until the groove 27*i* is engaged with the rear pivotal shaft 272 to be positioned. Then, the rear clamping plate 27*c* is forced to clamp with the front clamping plate 27*f* so as to steadily clamp the inserted front plate 22 (or distal plate 23). Thus, the present invention can be attached easily and rapidly, as shown in FIG. 17. On the contrary, as the bed is to be detached, it is only necessary to move the pressing plate 27*b* backwards, as shown in FIG. 16, the rear clamping plate 27*c* will open to release the front plate 22 (or distal plate 23).

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A hospital bed comprising:

a bed frame installed with a driving device;

a bed platform structured with a plurality of plates and being driven by the driving device to elevate the bed platform;

a front plate attached at a front end of the bed frame by clamping pieces;

a distal plate attached at a rear end of the bed frame by clamping pieces; and at least two movable side rails respectively installed at two sides of the bed frame and separately lifted or descended by a patient, each of said slide rails having an inner concave groove on a side thereof for offering a place for finger insertion to push or pull the side rail for lifting or descending, an inner side of at least one side rail having a controller for controlling the driving device, the clamping pieces including:

a fixing seat having a bottom plate and a front clamping plate, the bottom plate being fixed on the bed frame, and the front clamping plate being formed with a movable hole at its center, two sides of the movable hole being extended backwards to be formed with two parallel outer lateral plates, and a rear pivotal shaft passes through the space between the two outer lateral plates;

a pressing plate having two side extending rearwardly to form two parallel inner lateral plates, the two inner lateral plates being formed with a front through hole and a rear through hole respectively arranged at a front position and at a rear position, the two inner lateral plates of the pressing plate being inserted into the movable hole and the rear pivot shaft being passed through the rear pivotal hole, whereby the pressing plate is rotatable with respect to the fixing seat, a front pivotal shaft being passed through the front through hole;

a movable rear clamping plate being combined with the fixing seat by a bottom thereof and being formed with a space for clamping the front plate and the distal plate; and a tightening block disposed between the two lateral plates and formed with a pivotal hole, the front pivotal shaft being passed through the pivotal hole, the tightening block having a first groove formed therein for releasable engagement with the rear pivotal shaft, the front pivotal shaft and the first groove being respectively arranged at a front position and a rear position.

2. The hospital bed as claimed in claim 1, wherein a vertical long hole is formed on the rear clamping plate, a rear end of the tightening plate extends with a screw rod penetrating through the long hole and confined by a nut.

3. The hospital bed as claimed in claim 1, wherein a twisting spring is installed at the front pivotal shaft between the two inner lateral plates, one end of the twisting spring resists against the pressing plate, while another end resists against a stopping pin installed below the rear pivotal shaft between the two outer lateral plate.

4. The hospital bed as claimed in claim 3, wherein the front end of the tightening block is formed with a second grove penetrating through the pivotal hole thereof so that the twisting spring is installed on the front pivotal shaft within the second groove.

5. The hospital bed as claimed in claim 1, wherein at least one hole is formed near the bottom of the rear clamping plate, while at each correspondent position at the rear sides of two outer lateral plates of the fixing seat is formed with at least one hook, so that by the hook to be engaged with the hole, the rear clamping plate can be movably combined to the fixing seat.

6. A hospital bed comprising:

a bed frame installed with a driving device;

a bed platform structured with a plurality of plates formed of injected molded plastic and being driven by the driving device to elevate the bed platform, the bed platform having a top surface made with a plurality of slide-proof strips;

a front plate attached at a front end of the bed frame by clamping pieces;

a distal plate attached at a rear end of the bed frame by clamping pieces; and at least two movable side rails respectively installed at two sides of the bed frame and separately lifted or descended by a patient, each of said slide rails having an inner concave groove on a side thereof for offering a place for finger insertion to push or pull the side rail for lifting or descending, an inner side of at least one side rail having a controller for controlling the driving device.

* * * * *